United States Patent [19]

Balcombe

[11] 3,937,041

[45] Feb. 10, 1976

[54] HIGH RELIEF DOUBLE KNIT FABRIC

[75] Inventor: Bobby L. Balcombe, Greenville, S.C.

[73] Assignee: Phillips Fibers Corporation, Greenville, S.C.

[22] Filed: Oct. 21, 1974

[21] Appl. No.: 516,476

[52] U.S. Cl. ..... 66/197

[51] Int. Cl.[2] ..... D04B 9/06

[58] Field of Search ..... 66/200, 198, 180, 196, 66/197

[56] References Cited

UNITED STATES PATENTS

| | | | |
|---|---|---|---|
| 2,170,741 | 8/1939 | Ware | 66/197 |
| 2,201,980 | 5/1940 | Artzt et al. | 66/200 |
| 3,568,475 | 3/1971 | Philip | 66/200 X |
| 3,609,999 | 10/1971 | Blore | 66/196 |
| 3,626,714 | 12/1971 | Blore | 66/196 |
| 3,808,843 | 5/1974 | Blore et al. | 66/196 |

FOREIGN PATENTS OR APPLICATIONS

| | | | |
|---|---|---|---|
| 181,511 | 12/1935 | Switzerland | 66/200 |
| 252,543 | 10/1970 | U.S.S.R. | 66/197 |

OTHER PUBLICATIONS

Knitting Times, Sept. 13, 1971, Vol. 40, No. 38, pp. 67–73.

The Hosiery Trade Journal, May, 1972, Vol. 79, No. 941, pp. 114–118.

*Primary Examiner*—Wm. Carter Reynolds

[57] ABSTRACT

A double knit fabric having a high relief of small puffs on the back of the fabric and a substantially smooth surface on the front of the fabric wherein said puffs are elliptical in shape and alternate in vertical rows with a depressed portion of the fabric that is double knitted and alternate in a checkerboard pattern with adjoining rows of puffs.

10 Claims, 3 Drawing Figures

HIGH RELIEF DOUBLE KNIT FABRIC

This invention relates to a double knit fabric. In a specific aspect the invention relates to a double knit fabric having areas of high relief on one side thereof.

It is frequently desirable for reasons of comfort as well as for aesthetic reasons that a fabric have areas of high relief. This is particularly true for fabrics employed in upholstery. Thus it is an object of the present invention to provide a new and improved fabric. It is an object of the invention to provide a new double knit fabric having areas of high relief. Other objects, aspects and advantages of the invention will be apparent from a study of the specification, the drawings and the appended claims to the invention.

In the drawings

Figure 1:
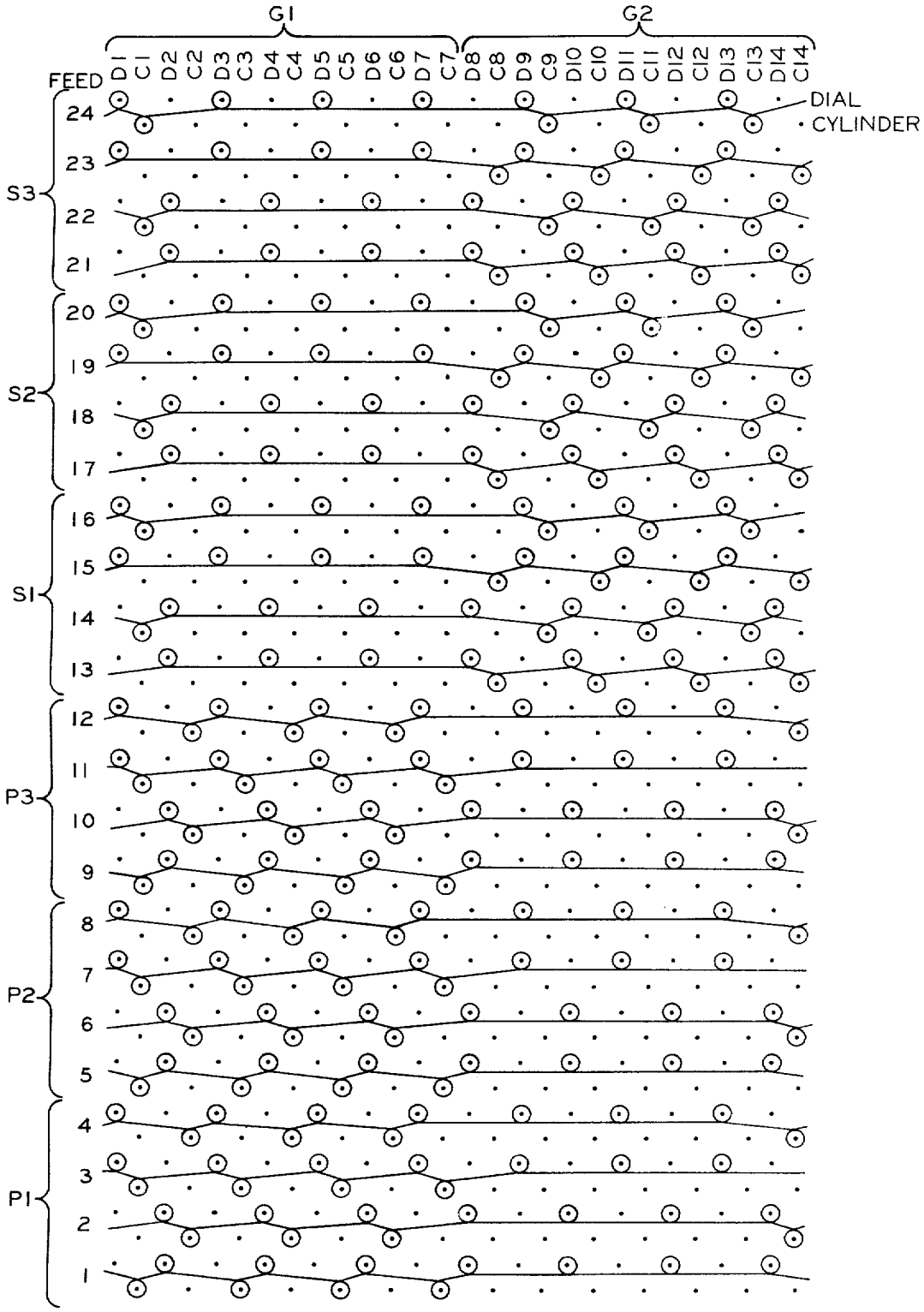
FIG. 1 is a pattern diagram of the face stitches formed by the cylinder needles and the reverse side stitches formed by the dial needles in the repeat pattern for a fabric in accordance with one embodiment of the invention.
Figure 2:
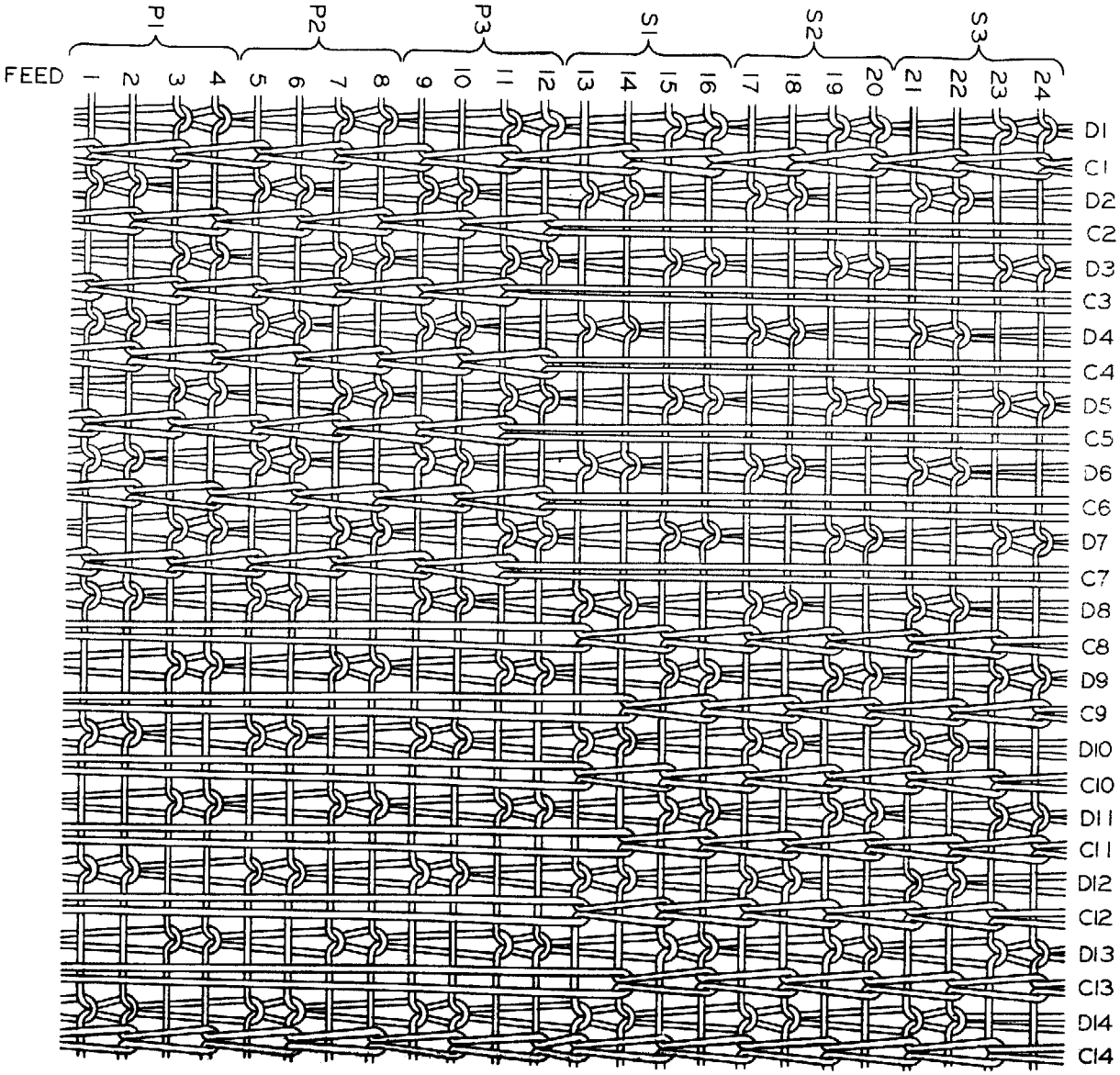
FIG. 2 is a schematic representation of a theoretical stitch construction of a double knit fabric utilizing the repeat pattern of FIG. 1, with the stitches being expanded laterally to show both the face stitches and the reverse side stitches.

Referring now to the drawings in detail and to FIGS. 1 and 2 in particular, the double knit fabric has a first set of alternating wales C1, C2, C3 . . . C13 and C14 formed by the knitting action of the cylinder needles and a second set of alternating wales D1, D2, D3 . . . D13 and D14 formed by the knitting action of the dial needles. The cylinder wales C1 . . . C14, which form the face of the fabric, alternate with the dial wales D1 . . . D14, which form the reverse side of the fabric. Thus each cylinder wale in the interior of the fabric is positioned between two dial wales. In the finished fabric the set of cylinder wales are in a plane generally parallel to the set of dial wales, and the fabric contracts laterally so that the set of cylinder wales contact each other to form the face of the fabric and the set of dial wales contact each other to form the reverse side of the fabric.

The fabric has a vertical repeat pattern of at least one primary set of consecutive courses followed by at least one secondary set of consecutive courses. The fabric illustrated in FIG. 1 has a vertical repeat pattern of three primary sets P1, P2, and P3 followed by three secondary sets S1, S2 and S3. Any desired number of primary and secondary sets can be employed in the repeat pattern, and the number of primary sets can be the same as or different from the number of secondary sets employed. The number of courses in the repeat pattern will generally be limited only by the pattern generating device utilized, for example a Jacquard mechanism, utilizing pattern wheels, punched discs, punched cards, perforated rolls, programmed tape, or electronic programming. The fabric has a horizontal repeat pattern of a first group G1 of consecutive wales followed by a second group G2 of consecutive wales. Each first group G1 of consecutive wales contains at least four cylinder wales and at least four dial wales. Similarly, each second group G2 of consecutive wales contains at least four cylinder wales and at least four dial wales. Any desired number of wales in excess of these minimums can be employed in the first and second groups of consecutive wales, and the total number of dial and cylinder wales in the first group can be the same as or different from the total number of dial and cylinder wales in the second group. The number of dial wales in either the first or the second group can be the same as or different from the number of cylinder wales in the respective group. In general the number of wales in the repeat pattern will be determined by the number of needles or a factor of the number of needles in the cylinder. In the illustrated fabric, the first group G1 of consecutive wales contains cylinder wales C1, C2, C3, C4, C5, C6 and C7 and dial wales D1, D2, D3, D4, D5, D6 and D7, while the second group G2 of consecutive wales contains cylinder wales C8, C9, C10, C11, C12, C13 and C14 and dial wales D8, D9, D10, D11, D12, D13 and D14.

Each primary set of consecutive courses contains, consecutively, first, second, third and fourth courses. Feeds 1, 2, 3 and 4 are the first, second, third and fourth courses, respectively, of the first primary set P1. Feeds 5, 6, 7 and 8 are the first, second, third and fourth courses, respectively, of the second primary set P2. Feeds 9, 10, 11 and 12 are the first, second, third and fourth courses, respectively, of the third primary set P3. The first and second courses of each primary set of consecutive courses have knit stitches in a first series of wales of the second set of alternating wales and welt stitches in a second series of wales of the second set of alternating wales. The third and fourth courses of each primary set have knit stitches in the second series of wales of the second set of alternating wales and welt stitches in the first series of wales of the second set of alternating wales. In the illustrated fabric, the members of the first series are the even numbered dial stitches and the members of the second series are the odd numbered dial stitches. The first and third courses of each primary set of consecutive courses have knit stitches in an alpha series of wales of the first set of alternating wales in the first group G1 of consecutive wales and welt stitches in a beta series of wales of the first set of alternating wales in the first group G1 of consecutive wales. The second and fourth courses of each primary set have knit stitches in the beta series of wales of the first set of alternating wales in the first group of consecutive wales and welt stitches in the alpha series of wales of the first set of alternating wales in the first group of consecutive wales. In the illustrated fabric the members of the alpha series are the odd numbered cylinder wales and those in the first group G1 are C1, C3, C5 and C7, and the members of the beta series are the even numbered cylinder wales and those in the first group G1 are C2, C4 and C6. The first, second, third and fourth courses of each primary set of consecutive courses have welt stitches in at least substantially all of the cylinder wales in the second group of consecutive wales. In the illustrated fabric, there are welt stitches in all of the cylinder wales C8, C9, C10, C11, C12, C13 and C14 in the second group G2 for the first and third courses, and welt stitches in cylinder wales C8, C9, C10, C11, C12 and C13 for the second and fourth courses, there being a knit stitch in the last even numbered cylinder wale C14 in each of the second and fourth courses.

Similarly, each secondary set S1, S2, and S3, contains first, second, third and fourth courses. Feeds 13, 14, 15 and 16 are the first, second, third and fourth courses for secondary set S1; feeds 17, 18, 19 and 20 are the first, second, third and fourth courses for secondary set S2; and feeds 21, 22, 23 and 24 are the first, second, third and fourth courses for secondary set S3. The first and second courses of each secondary set have knit stitches in the first series of dial wales and welt stitches in the second series of dial wales. The third and fourth courses of each secondary set have welt stitches in the first series of dial wales and knit stitches in the second series of dial wales. The first, second, third and fourth courses of each secondary set have welt stitches in at least substantially all of the cylinder wales of the first group of consecutive wales. In the illustrated fabric there is a knit stitch in the first odd numbered cylinder wale in each of the second and fourth courses of each secondary set and welt stitches in all of the remaining cylinder wales in the first group G1 for each of the first, second, third and fourth courses. The first and third courses of each secondary set of consecutive courses have knit stitches in the beta series of cylinder wales in group G2 and welt stitches in the alpha series of cylinder wales in group G2. The second and fourth courses of each secondary set have knit stitches in the alpha series in group G2 and welt stitches in the beta series of cylinder wales in group G2. In the illustrated fabric the members of the alpha series in group G2 are C9, C11 and C13 and the members of the beta series in group G2 are C8, C10, C12 and C14.

Figure 3:
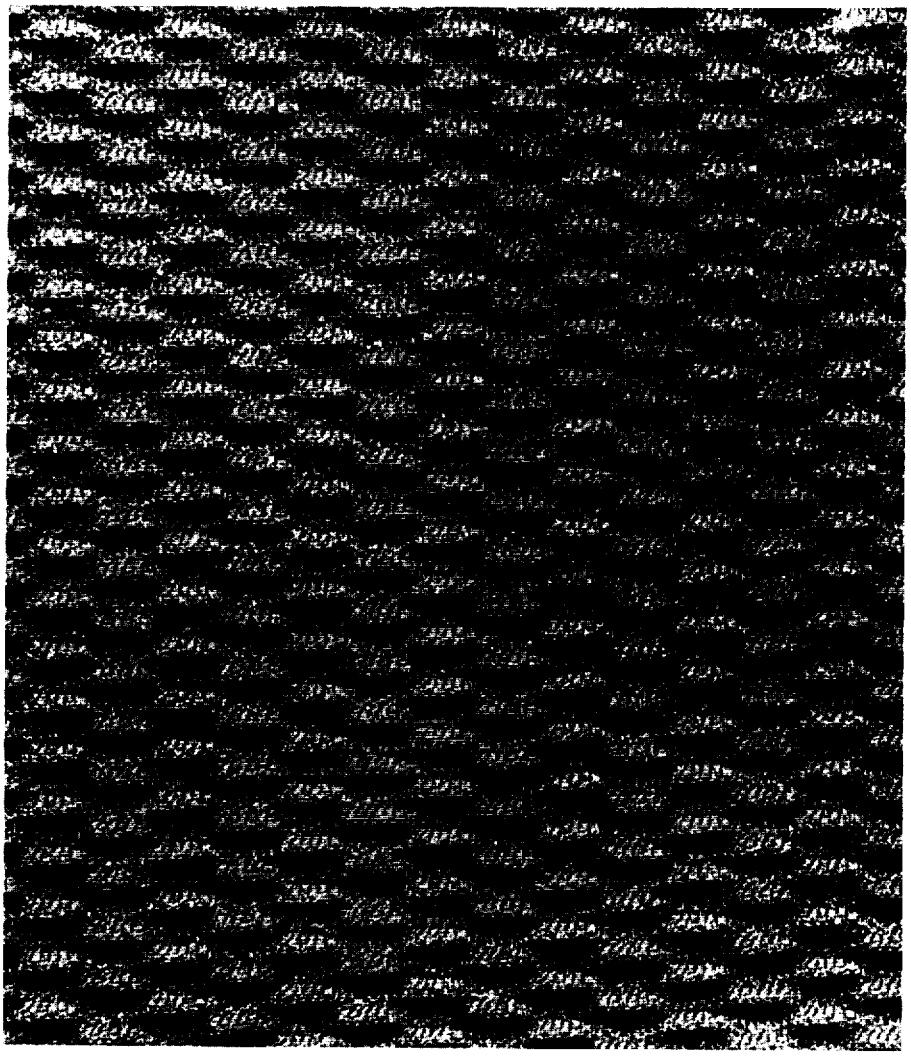
FIG. 3 is a photographic reproduction of the reverse side of a double knit fabric prepared in accordance with the invention.

Referring now to FIG. 3, there is shown a photographic reproduction of the reverse side of a double knit fabric prepared with the repeat pattern of FIG. 1. The fabric is substantially smooth on the face side. The fabric has high relief on the reverse side in the form of small generally elliptically shaped puffs which alternate in each vertical row with depressed portions of the fabric where the dial stitches intermesh with the cylinder knit stitches. The dial stitches in the puffs do not intermesh with the corresponding cylinder welt stitches. The puffs form because these areas of the reverse side contain more fabric than the portions of fabric formed by the series of contiguous welt stitches in the cylinder wales. While the fabric can be formed from unbulked yarn, it is advantageous to employ bulked yarns. The puffs in adjacent vertical rows are staggered to form a checkerboard pattern. The vertical length of each puff can be varied by varying the number of primary and secondary sets in the repeat pattern, while the horizontal width of each puff can be varied by varying the number of wales in each first and second groups of consecutive wales. If desired, horizontal spacing between puffs in adjacent rows can be increased by interposing a third group of consecutive wales between each first group G1 and each adjacent second group G2 with the knitting pattern for the third group having sufficient knit stitches in each of the dial wales and the cylinder wales to provide flat areas of fabric. Other reasonable variations and modifications are possible within the scope of the foregoing disclosure, the drawings and the appended claims to the invention.

What is claimed is:

1. A double knit fabric comprising a first set of alternating wales forming the face of said fabric, and a second set of alternating wales forming the reverse side of said fabric, each interior wale of said first set of alternating wales being positioned between two wales of said second set of alternating wales;

said fabric having a repeat pattern of at least one primary set of consecutive courses followed by at least one secondary set of consecutive courses and a first group of consecutive wales followed by a second group of consecutive wales, each said first group of consecutive wales containing at least four wales in said first set of alternating wales and at least four wales in said second set of alternating wales, each said second group of consecutive wales containing at least four wales in said first set of alternating wales and at least four wales in said second set of alternating wales;

each said primary set of consecutive courses comprising, consecutively, first, second, third and fourth courses;

the first course of each said primary set of consecutive courses having knit stitches in a first series of wales of said second set of alternating wales, welt stitches in a second series of wales of said second set of alternating wales, said wales of said second series generally alternating with said wales of said first series, knit stitches in an alpha series of wales of said first set of alternating wales in said first group of consecutive wales, and welt stitches in a beta series of wales of said first set of alternating wales in said first group of consecutive wales and in at least substantially all of the wales of said first set of alternating wales in said second group of consecutive wales, said wales of said beta series generally alternating with the wales of said alpha series;

the second course of each said primary set of consecutive courses having knit stitches in said first series of wales of said second set of alternating wales, welt stitches in said second series of wales of said second set of alternating wales, knit stitches in said beta series of wales of said first set of alternating wales in said first group of consecutive wales, and welt stitches in said alpha series of wales of said first set of alternating wales in said first group of consecutive wales and in at least substantially all of the wales of said first set of alternating wales in said second group of consecutive wales;

the third course of each said primary set of consecutive courses having knit stitches in said second series of wales of said second set of alternating wales, welt stitches in said first series of wales of said second set of alternating wales, knit stitches in said alpha series of wales of said first set of alternating wales in said first group of consecutive wales and welt stitches in said beta series of wales of said first set of alternating wales in said first group of consecutive wales and in at least substantially all of the wales of said first set of alternating wales in said second group of consecutive wales;

the fourth course of each said primary set of consecutive courses having knit stitches in said second series of wales of said second set of alternating wales, welt stitches in said first series of wales of said second set of alternating wales, knit stitches in said beta series of wales of said first set of alternating wales in said first group of consecutive wales, and welt stitches in said alpha series of wales of said first set of alternating wales in said first group of consecutive wales and in at least substantially all of the wales of said first set of alternating wales in said second group of consecutive wales;

each said secondary set of consecutive courses comprising, consecutively, first, second, third and fourth courses;

the first course of each said secondary set of consecutive courses having knit stitches in said first series of wales of said second set of alternating wales, welt stitches in said second series of wales of said second set of alternating wales, knit stitches in said beta series of wales of said first set of alternating wales in said second group of consecutive wales, and welt stitches in said alpha series of wales of said first set of alternating wales in said second group of consecutive wales and in at least substantially all of the wales of said first set of alternating wales in said first group of consecutive wales;

the second course of each said secondary set of consecutive courses having knit stitches in said first series of wales of said second set of alternating wales, welt stitches in said second series of wales of said second set of alternating wales, knit stitches in said alpha series of wales of said first set of alternating wales in said second group of consecutive wales, and welt stitches in said beta series of wales of said first set of alternating wales in said second group of consecutive wales and in at least substantially all of the wales of said first set of alternating wales in said first group of consecutive wales;

the third course of each said secondary set of consecutive courses having knit stitches in said second series of wales of said second set of alternating wales, welt stitches in said first series of wales of said second set of alternating wales, knit stitches in said beta series of wales of said first set of alternating wales in said second group of consecutive wales, and welt stitches in said alpha series of wales of said first set of alternating wales in said second group of consecutive wales and in at least substantially all of the wales of said first set of alternating wales in said first group of consecutive wales; and the fourth course of each said secondary set of consecutive courses having knit stitches in said second series of wales of said second set of alternating wales, welt stitches in said first series of wales of said second set of alternating wales, knit stitches in said alpha series of wales of said first set of alternating wales in said second group of consecutive wales, and welt stitches in said beta series of wales of said first set of alternating wales in said second group of consecutive wales and in at least substantially all of the wales of said first set of alternating wales in said first group of consecutive wales.

2. A double knit fabric in accordance with claim 1 wherein the members of said first series of wales are the even numbered wales of said second set of alternating wales, and the members of said second series of wales are the odd numbered wales of said second set of alternating wales.

3. A double knit fabric in accordance with claim 2 wherein the members of said alpha series of wales are the odd numbered wales of said first set of alternating wales, and the members of said beta series of wales are the even numbered wales of said first set of alternating wales.

4. A double knit fabric in accordance with claim 3 wherein said repeat pattern comprises three of said primary sets of consecutive courses followed by three of said secondary sets of courses.

5. A double knit fabric in accordance with claim 4 wherein each said first group of consecutive wales contains seven wales in said first set of alternating wales and seven wales in said second set of alternating wales.

6. A double knit fabric in accordance with claim 5 wherein each said second group of consecutive wales contains seven wales in said first set of alternating wales and seven wales in said second set of alternating wales.

7. A double knit fabric in accordance with claim 6 wherein there are knit stitches in the last even numbered wale of said first set of alternating wales in said second group of wales for each second and fourth course of each primary set of consecutive courses, and welt stitches in all of the remaining wales of said first set of alternating wales in said second group of consecutive wales for each course of each said primary set of consecutive courses; and wherein there are knit stitches in the first odd numbered wale of said first set of alternating wales in said first group of wales for each second and fourth course of each secondary set of consecutive courses and welt stitches in all of the remaining wales of said first set of alternating wales in said first group of consecutive wales for each course of each said secondary set of consecutive courses.

8. A double knit fabric in accordance with claim 1 wherein said repeat pattern comprises three of said primary sets of consecutive courses followed by three of said secondary sets of consecutive courses.

9. A double knit fabric in accordance with claim 8 wherein each said first group of consecutive wales contains seven wales in said first set of alternating wales and seven wales in said second set of alternating wales.

10. A double knit fabric in accordance with claim 9 wherein each said second group of consecutive wales contains seven wales in said first set of alternating wales and seven wales in said second set of alternating wales.

* * * * *